US009488440B2

(12) United States Patent
Izumi et al.

(10) Patent No.: US 9,488,440 B2
(45) **Date of Patent: *Nov. 8, 2016**

(54) ILLUMINATION DEVICE AND METHOD

(71) Applicant: Battle Tek Industries Incorporated, Sunnyvale, CA (US)

(72) Inventors: Terry Izumi, Glendale, CA (US); Adam M. Gettings, Red Wing, MN (US); Nathan D. Gettings, Palo Alto, CA (US)

(73) Assignee: Sellmark Corporation, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/460,259

(22) Filed: Aug. 14, 2014

(65) Prior Publication Data

US 2014/0355258 A1 Dec. 4, 2014

Related U.S. Application Data

(63) Continuation of application No. 14/052,384, filed on Oct. 11, 2013, now Pat. No. 8,807,779, which is a continuation of application No. 13/347,843, filed on Jan. 11, 2012, now Pat. No. 8,662,694.

(51) Int. Cl.
*F41G 1/34* (2006.01)
*F41G 1/35* (2006.01)
*F41C 23/10* (2006.01)

(52) U.S. Cl.
CPC ..... *F41G 1/35* (2013.01); *F41C 23/10* (2013.01); *F41G 1/34* (2013.01)

(58) Field of Classification Search
CPC ..... F41G 1/34
USPC ..... 362/109, 110, 113, 114; 42/1.01, 106, 42/111, 114, 117
See application file for complete search history.

(56) References Cited

U.S. PATENT DOCUMENTS

| | | | | |
|---|---|---|---|---|
| 4,777,754 | A | 10/1988 | Reynolds, Jr. | |
| 5,435,091 | A | 7/1995 | Toole et al. | |
| 6,578,311 | B2 | 6/2003 | Danielson et al. | |
| 6,671,991 | B1 | 1/2004 | Danielson | |
| 7,172,311 | B2 * | 2/2007 | Ross | F41G 1/35 362/110 |
| 7,194,836 | B1 * | 3/2007 | Urban | 42/60 |
| 7,260,910 | B2 | 8/2007 | Danielson | |
| 7,441,364 | B2 * | 10/2008 | Rogers | F41G 1/35 42/114 |
| D616,957 | S | 6/2010 | Rievley et al. | |
| 7,805,876 | B1 | 10/2010 | Danielson et al. | |
| 8,109,024 | B2 * | 2/2012 | Abst | F41A 19/06 124/31 |
| D669,552 | S | 10/2012 | Essig et al. | |
| D669,957 | S | 10/2012 | Hughes et al. | |
| D676,097 | S | 2/2013 | Izumi | |
| 8,662,694 | B1 | 3/2014 | Izumi et al. | |
| 8,807,779 | B1 * | 8/2014 | Izumi et al. | 362/114 |
| 2009/0122527 | A1 * | 5/2009 | Galli | 362/110 |
| 2010/0058640 | A1 * | 3/2010 | Moore | F41G 1/35 42/114 |
| 2011/0138667 | A1 | 6/2011 | Bolden | |

* cited by examiner

*Primary Examiner* — Andrew Coughlin
*Assistant Examiner* — Meghan Ulanday
(74) *Attorney, Agent, or Firm* — Mark D. Perdue

(57) ABSTRACT

An illumination device for use with a firearm and a method of using the same are disclosed. The illumination device can include a gun grip cover configured to attach to a gun grip. The illumination device can have a first illumination element extending to the left of the gun grip cover and a second illumination element extending to the right of the gun grip cover. The illumination elements can deliver a spread of light to illuminate a large area. The illumination elements can be laterally adjacent to the barrel. The illumination elements can be controlled by a control switch positioned below the trigger.

11 Claims, 7 Drawing Sheets

NOT INVENTION

ILLUMINATION DEVICE AND METHOD

CROSS-REFERENCE TO RELATED APPLICATION

This application is a continuation of U.S. patent application Ser. No. 14/052,384, filed Oct. 11, 2013, issued as U.S. Pat. No. 8,807,779, which is a continuation of U.S. patent application Ser. No. 13/347,843, filed Jan. 11, 2012, issued as U.S. Pat. No. 8,662,694, which are herein incorporated by reference in their entireties.

BACKGROUND

1. Technical Field

The disclosure relates to an illumination device for a firearm. More specifically, the disclosure relates to a gun grip cover having an integrated light.

2. Summary of the Art

When security personnel, such as police, investigate dark areas under threat of violence, they often hold their firearm—often a handgun—with one hand and a flashlight with the other hand. This not only prevents them from grasping the firearm with both hands—which is known as being more stable and accurate than grasping the firearm with one hand—but also limits the utility of their other hand even if they were to maintain a one-handed grip on their gun.

Laser sights are available for firearms, but such sights only provide a focused laser beam with which to check the aim of the gun against a target. These sights fail to provide spread light that can illuminate an area.

Furthermore, holding or attaching a flashlight on one side of the gun limits the utility of the light emitted because half of the area is likely to still be relatively dark because of the shadow cast by the gun itself. Flashlights are also often bulky compared to firearms. Flashlights are also not ergonomically designed to be operated in conjunction with a firearm, even when attached to the firearm. When the flashlight is not attached to the firearm, it is even more difficult to turn the light on and off, point the flashlight, and hold and aim the gun all at the same time even with two hands.

Flashlights that are attachable to handguns are typically attachable to the barrel. These lights also often take large enough batteries, causing a significant change in the weight distribution of the handgun which in turn affects the ability to hold and aim the firearm. For example, some existing barrel-attached flashlights are 108 g and 125 g and move the center of mass of the gun along the barrel. Handguns typically have a center of mass near the front of the handle, so the shift of the center of mass with a barrel-mounted flashlight gives the handgun an unnatural, and unexpected forward-shifted balance.

These flashlights also prevent the handgun from being placed into a standard issue holster. The flashlight must be removed from the gun before the gun is holstered, and then the flashlight must be re-attached to the gun after the gun is withdrawn from the holster.

What is desired is an illumination device that can be held and operated single-handedly in combination with a gun. An illumination device is also desired that can project light on all or almost all sides of a gun concurrently while holding the gun. An illumination device is also desired that can be attached to a gun without significantly increasing the weight or weight distribution of the gun and illumination device combination compared with the gun without the illumination device. An illumination device is desired that when installed on a handgun will allow the handgun to fit into a standard holster.

SUMMARY OF THE INVENTION

An illumination device is disclosed. The illumination device can be used with a gun having a grip. The gun can be a handgun, rifle or shotgun. The device can have a grip cover that can be attached to or integral with the grip of the gun. The grip cover can have an illumination activation control interface, such as a button, and a first illumination element, such as an LED, incandescent or fluorescent bulb, configured to deliver uncollimated light.

The first illumination element can be positioned at the top of the grip cover. The device of claim 1, wherein the illumination activation control interface can have a button. The illumination activation control interface can be positioned below a trigger on the gun. The first illumination element can extend laterally beyond the surface of the remainder of the grip cover.

The grip cover can have a second illumination element. The first illumination element can be on a first lateral side of the grip cover, and the second illumination element can be on a second lateral side of the grip cover opposite to the first lateral side of the grip cover. The first illumination element can extend in a first lateral direction beyond the surface of the remainder of the grip cover, and the second illumination element can extend in a second lateral direction, opposite to the first lateral direction, beyond the surface of the remainder of the grip cover.

Another illumination device that can be used with a gun having a grip is disclosed. The illumination device can have a grip cover and an illumination element, such as an LED, incandescent or fluorescent bulb, configured to delivered spread light. The illumination element can be positioned at the top of the grip cover and can extend laterally beyond the surface of the remainder of the grip cover. The grip cover can have a fastener hole. The device can have a fastener that can be located in the fastener hole and the grip and fastens the device to the grip.

A method for using an illumination device on a gun having a grip is also disclosed. The method can include attaching the illumination device to the gun. The method can include holding the grip with a trigger finger hand. The method can also include activating the illumination device with the trigger finger hand. The holding of the grip can be concurrent with the activating of the illumination device. The activating of the illumination device can include controlling the illumination device to emit light.

The method can include discharging the gun concurrent with the activating of the illumination device. Attaching the illumination device to the gun can include attaching the illumination device to the grip.

DETAILED DESCRIPTION

Figure 1:
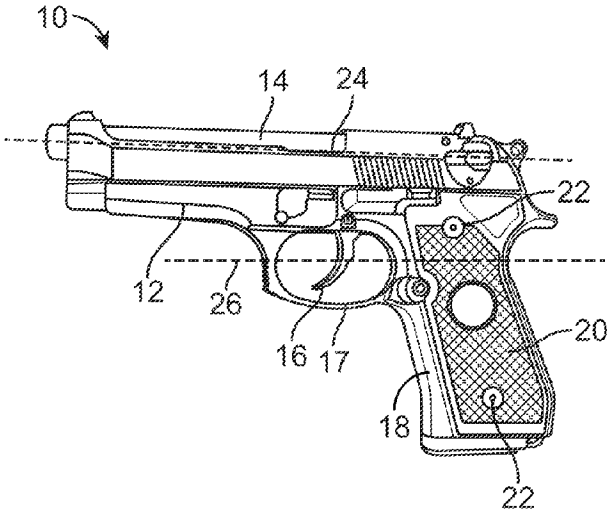
FIG. 1 illustrates a variation of a gun.

FIG. 1 illustrates that a gun 10 can have a receiver or frame 12, barrel 14 and trigger 16. The trigger 16 can be partially surrounded by a trigger guard 17. The gun 10 can be a handgun (as shown), rifle, or shotgun. The frame 12 can have a grip 18. The grip 18 can be integral with or attached to and detachable from the frame 12. The grip 18 can be integral with or attached to a stock.

The grip 18 can have a grip cover 20. The grip cover 20 can be integral with or attached to and detachable from the grip 18. Attachment elements or fasteners, such as brads, bolts or screws 22 can extend through the grip cover 20 and threadably attach to the grip 18, for example, removably attaching the grip cover 20 to the grip 18.

The barrel 14 can have a barrel longitudinal axis 24. A trigger finger axis 26 can be a lateral projection of the plane defined by the trigger finger when the hand is holding the grip 18 and the trigger finger is placed on the trigger 16. The trigger finger axis 26 can pass through the center of the exposed portion of the trigger 16.

Figure 2:
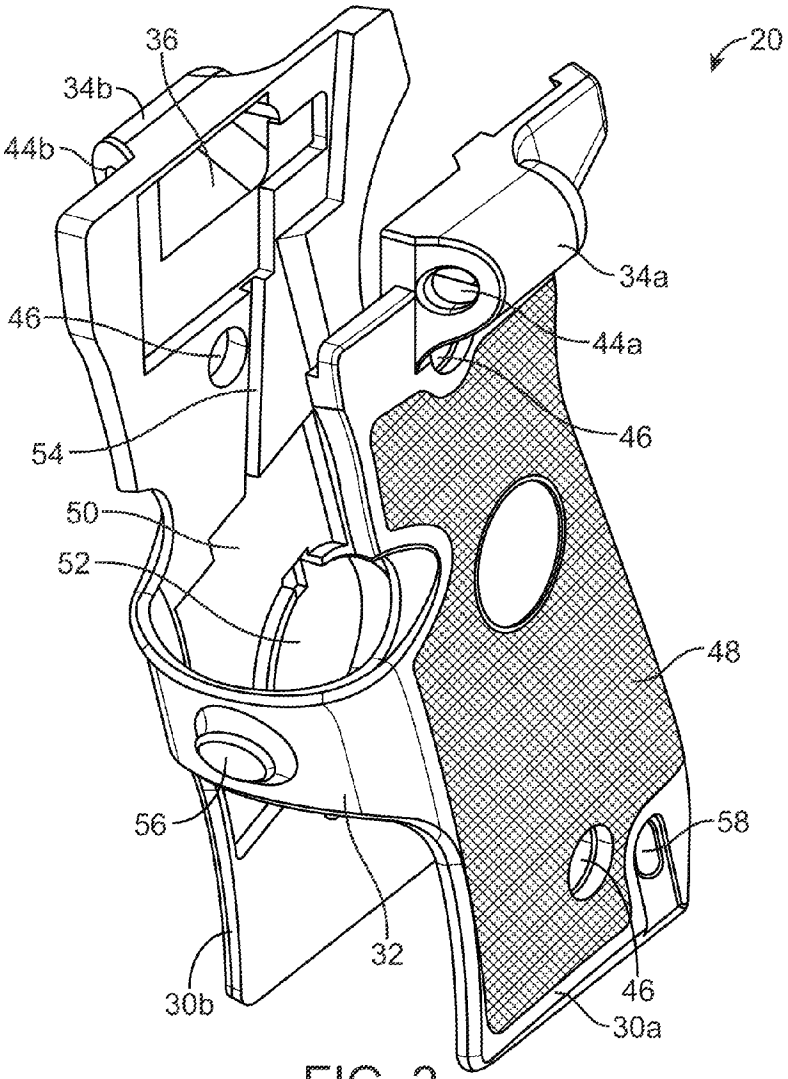
FIGS. 2 through 4 are perspective, front, and rear views, respectively, of a variation of the illumination device.
Figure 4:
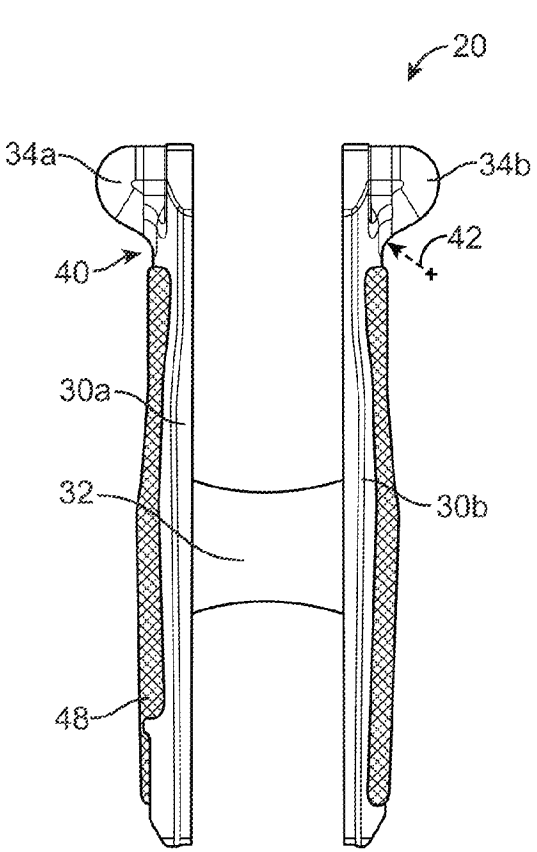
Figure 3:
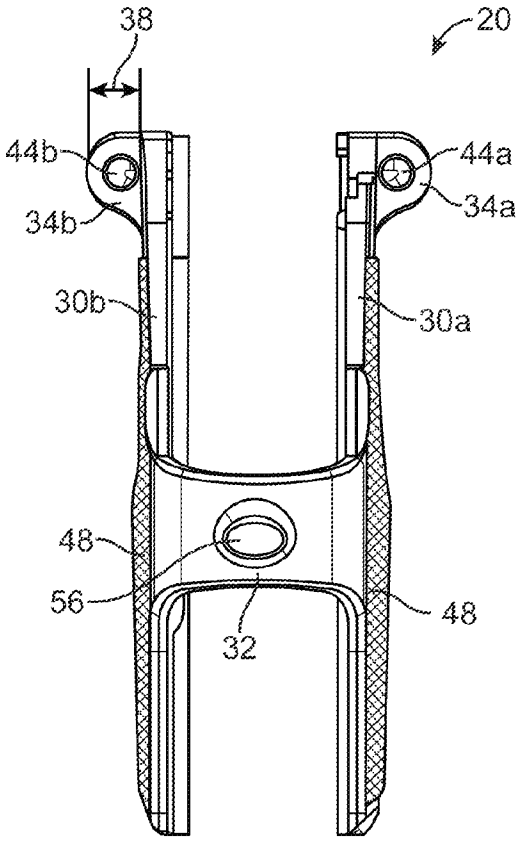

FIGS. 2 through 4 illustrate that the grip cover 20 can have first and second illumination elements, such as LEDs, incandescent, fluorescent (e.g., compact fluorescent), mercury vapor, xenon, neon, halogen bulbs, or combinations thereof. The illumination elements can emit uncollimated light or a spread of light. The emitted light can be visible white, blue, red, yellow, green, orange, infrared, ultraviolet (e.g., black light), or combinations thereof.

The grip cover 20 can have a first wall 30*a*, a second wall 30*b*, a bridge section or connecting strap 32 or combinations thereof. The first wall 30*a* can be integral or attachable and detachable with a first lateral side of the connecting strap 32. The second wall 30*b* can be integral or attachable and detachable with the second lateral side of the connecting strap 32 opposite the first lateral side of the connecting strap 32. The strap 32 can be on the front of the grip cover 20. A second strap (not shown) can be on the back of the grip cover 32. The second strap can be attached to or integral with one or both walls 30.

The grip cover 20 can have first and/or second illumination element holders 34*a* and 34*b*. The illumination element holders 34 can each have one or more illumination elements positioned in a hollow volume or cavity of the illumination element holder 34. The illumination element can be mechanically restrained, such as by snap fit or friction fit, in the hollow volume or cavity of the illumination element holder 34. The hollow volume of the illumination element holder 30 can be accessible by an illumination element access port 36. The illumination element access port 36 can be covered by a removable or openable strap, mesh, solid door or window, or combinations thereof.

The illumination element holders 34 can extend laterally from the respective walls 30 at an illumination element holder width 38. The element holder width 38 can be from about 0.5 mm (0.2 in.) to about 50 mm (2.0 in.), more narrowly from about 2 mm (0.08 in.) to about 20 mm (0.8 in.), for example about 8 mm (0.3 in.) or about 15 mm (0.6 in.). The top of the illumination element holders 34 can be coincidental with the tops (as shown) and/or bottoms of the walls 30. The illumination element holders 34 can have a hemi-cylindrical or otherwise rounded lateral side. The illumination element holders 34 can have a hemi-spherical or otherwise rounded rear. The illumination element holders 34 can have a flat front. The front of the illumination element holders 34 can extend perpendicular to the wall 30 or at an angle to the wall, such as from about 75° to about 90° from the wall, for example at about 80° from the wall. The lateral side of the illumination element holders 34 can form a concave finger rest 40. The finger rest 40 can have a finger rest radius of curvature 42. During use, the side of a finger can be positioned against the finger rest 40.

The illumination element holders 34*a* and 34*b* can have illumination ports 44*a* and 44*b*, respectively, that can be in visual communication with the outside of the element holders 34 and the illumination elements. The illumination ports 44 can be on the front of the illumination element holders 34. The illumination ports 44 can be open or covered with translucent or transparent lenses (i.e., with at least one partially or fully concave and/or convex surface) or covers (i.e., not lenses). The lenses can focus or broaden the spread of the light emitted by the illumination element. The lenses can change the frequency characteristics of the light (e.g., filtering out undesired frequencies, to change the color or be more appropriate for the environment, such as for use in a smoky area). The illumination port 44 can be covered with a fixed or removable opaque cover. The opaque cover can have a design, such as circular dots, squares, triangles, stars, lines, or combinations thereof, cut into the cover to allow light through the cover in the respective shape. The inner diameter surface of the illumination ports 44 and/or hollow volume of the illumination element holder 30 can be covered or coated with a light-reflective material, such as a silver-colored material, such as aluminum plating.

The walls 30 can each have one, two or more attachment ports 46. The attachment ports 46 can be configured to receive fasteners or attachment elements 22 to removably attach the grip cover 20 to the grip 18.

One or both walls 30, and/or the strap 32 can have surface texturing 48. The surface texturing can be knurling, beading, rippling, ridges, or combinations thereof.

The medial sides of the walls 30 can have cavities for positioning of electronics elements. For example, the medial sides of one or each of the walls 30 and/or the strap 32 can have a processor and/or circuit board cavity 50, a battery cavity 52. The medial sides of one or each of the walls 30 and/or the strap 32 can have one or more wiring channels 54 from the circuit board cavity 50 to the illumination element access port 36, from a control switch 56 or a control switch cavity, for example on the strap, to the circuit board cavity 50, and from a power switch 58, for example on one of the walls 30, to the circuit board cavity 50. The circuit board cavity 50 can be configured to hold the circuit board and/or processor. The battery cavity 52 can be configured to hold an electric cell or battery. The wiring channels 54 can be configured to hold wires, cords, cables, or combinations thereof. The wiring channels 54 can be wires or conductive lines on the surface (e.g., not recessed channels) of the medial sides of the walls 30 and/or strap 32.

Figure 5C:
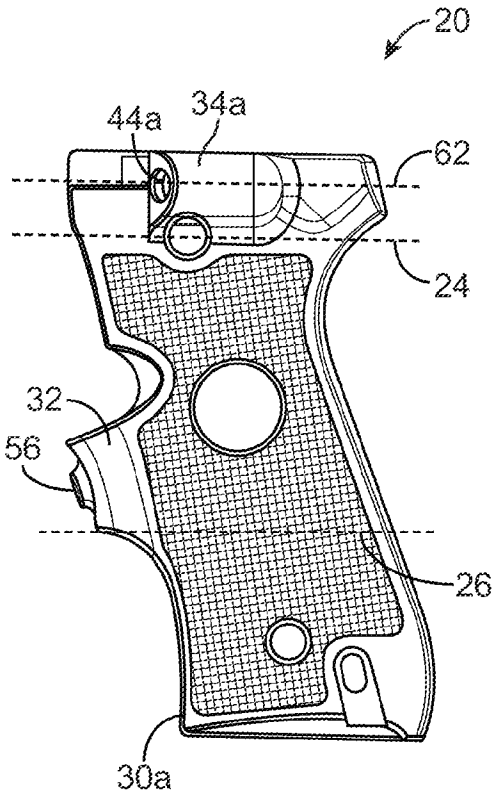
FIGS. 5*a* through 5*c* are side views of variations of the device of FIGS. 2 through 4.
Figure 5B:
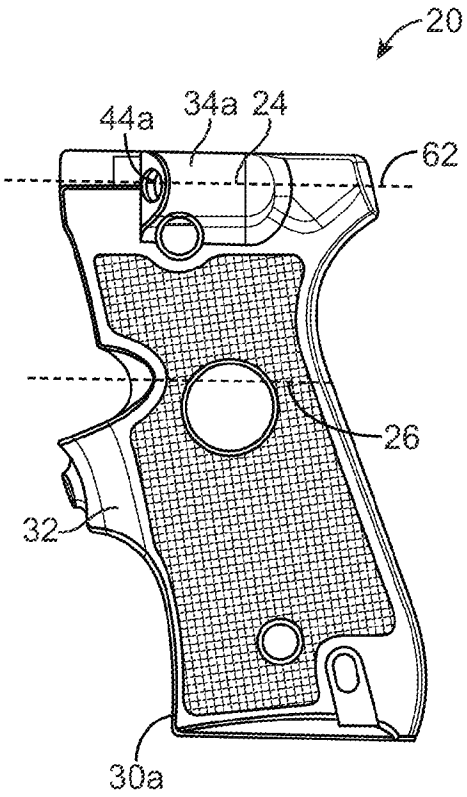
Figure 5A:
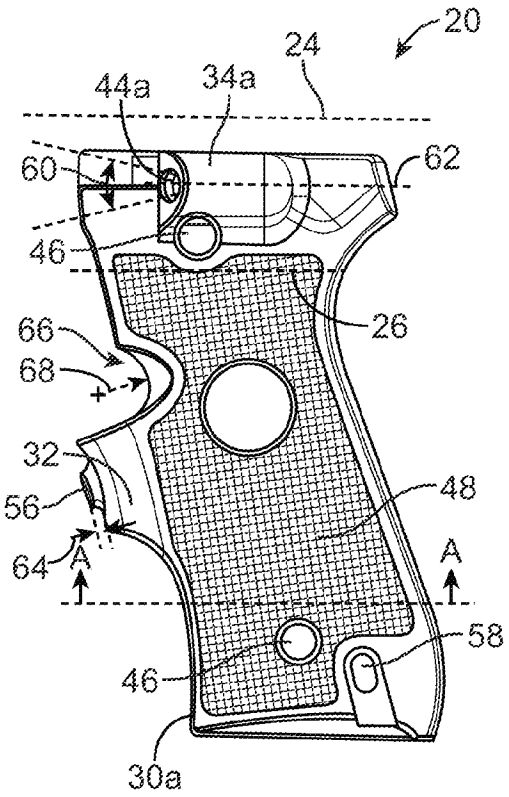

FIG. 5*a* illustrates that the light emitted from the illumination element can spread as the light is emitted out of the illumination port 44. The light can spread at a light spread angle 60 from about 10° to about 170°, for example about 130° or about 15°. The illumination element holder 34 can have an illumination element holder longitudinal axis 62.

When in a non-activated configuration, the control switch 56 can be flush with the front of the strap 32. When in a non-activated configuration, the control switch 56 can extend past the front of the remainder of the strap 32 by a button height 64. The button height 64 can be from about 0 mm (0 in.) (e.g., a touch sensor) to about 3 mm (0.1 in.), more narrowly from about 1 mm (0.04 in.) to about 1.5 mm (0.059 in.), for example about 1.2 mm (0.047 in.).

The grip cover 20 can have a trigger indentation 66 on the front of either or both of the walls 30. The bottom of the trigger indentation 66 can be coincidental with the top of the strap 32. The trigger indentation 66 can have a trigger indentation radius of curvature 68.

The grip cover 20 can be sized and positioned on the gun 10 so the illumination element holder longitudinal axis 62 is positioned below the barrel longitudinal axis 24. The illumination element holder longitudinal axis 62 can be positioned above the trigger finger axis 26. The control switch 56 can be positioned below the trigger finger axis 26. The control switch 56 can be positioned below a trigger guard. 17

FIG. 5*b* illustrates that the grip cover 20 can be sized and positioned on the gun 10 so the illumination element holder longitudinal axis 62 is positioned collinear with the barrel longitudinal axis 24. The trigger finger axis 26 can project across the trigger indentation 66, for example across the vertical center of the trigger indentation 66.

FIG. 5*c* illustrates that the grip cover 20 can be sized and positioned on the gun 10 so the illumination element holder longitudinal axis 62 is above the barrel longitudinal axis 24. The trigger finger axis 26 can be below the control switch 56 and/or the bottom of the strap 32.

The position of the grip cover 20 relative to the gun 10 can be changed between variations by altering the positions of the attachment ports 46 and the corresponding ports in the gun 10 relative to the remainder of the grip cover 20 and the gun 10, respectively.

Figure 6B:
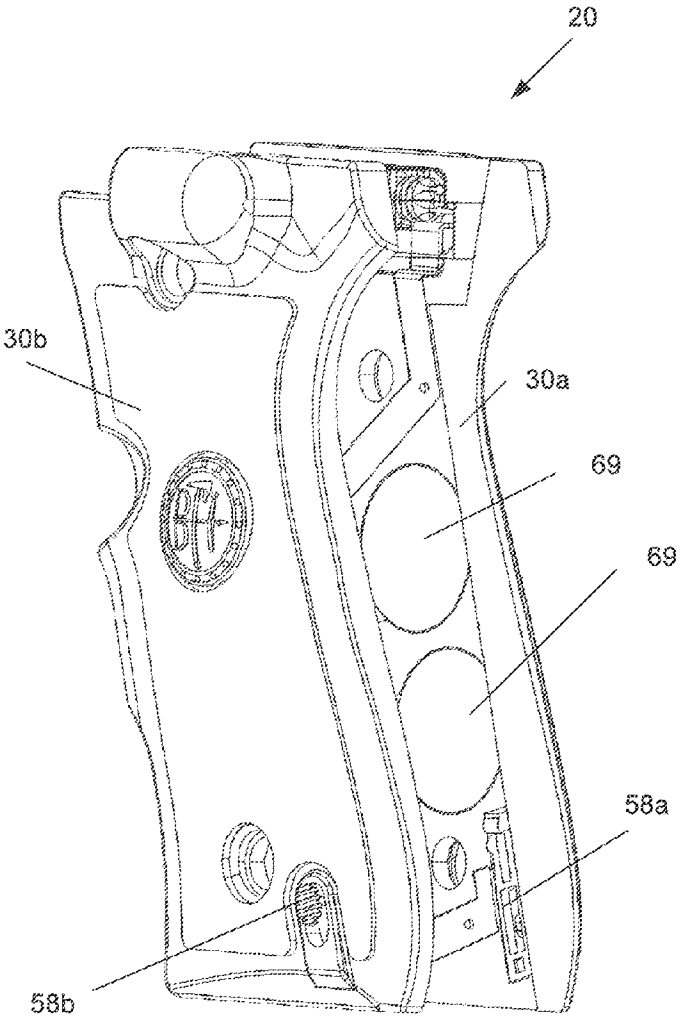
FIGS. 6*a* and 6*b* are right rear perspective and left rear perspective views of a variation of the device.
Figure 6A:
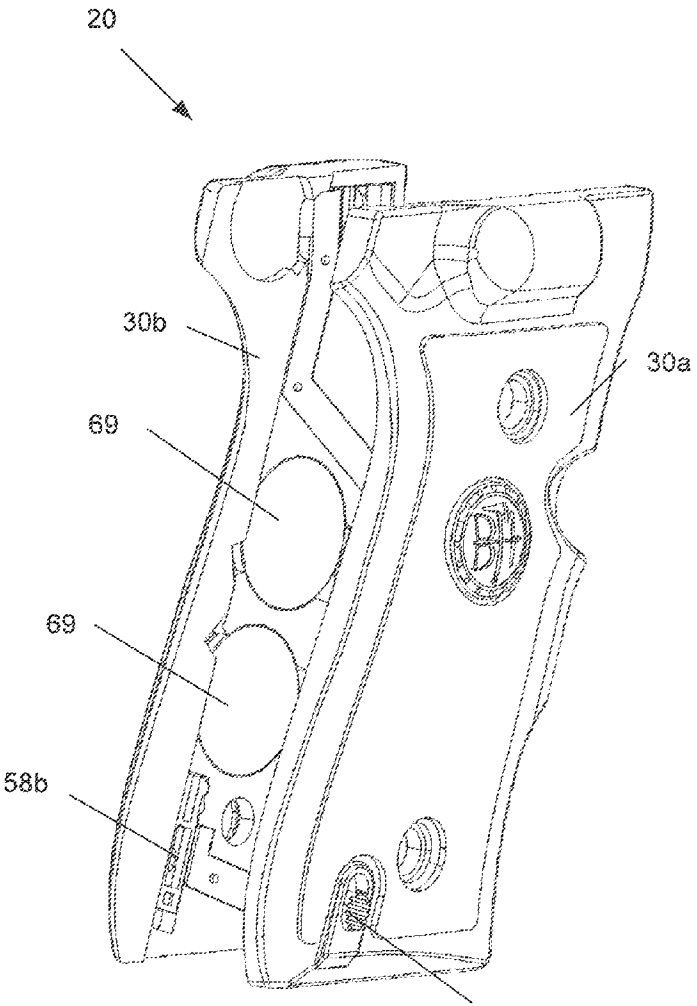

FIGS. 6*a* and 6*b* illustrate that each wall 30 can have two batteries 69. The batteries 69 in each wall 30 can power only the illumination devices on the corresponding side of the grip cover 20, or the illumination devices on both sides of the grip cover 20, or controllably switch between only powering one side and powering both sides, The batteries 69 can be replaced and/or rechargeable. The batteries 69 can be charged through a wired connector to a power source (e.g., a wall outlet) and/or through an inductive charger.

The right wall 30*a* can have a right power switch 58*a*. The left wall 30*b* can have a left power switch 58*b*. The right power switch 58*a* can be configured to control power delivery to only illumination devices on the right side of the grip cover 20 or to illumination devices on both sides of the grip cover 20. The left power switch 58*b* can be configured to control power delivery to only illumination devices on the left side of the grip cover 20 or to illumination devices on both sides of the grip cover 20.

Either of the right or left power switch 58*a* or 58*b* can be configured to be a master power switch connecting and disconnecting the power to the circuit board 80. The circuit board 80 can have multiple operating modes (i.e., be multimodal). The remaining (i.e., not the master power switch) power switch 58*a* or 58*b* can operate as a mode switch configured to select the operating mode of the circuit board 80. The position of the mode switch can be changed. The position of the mode switch can control the software program executing on the circuit board 80 (e.g., on a processor) operating the illumination elements. For example, the mode switch can control the circuit board 80 flash the illumination elements at steady (i.e., a consistent frequency), or random intervals, or cause the illumination elements to make a variety of colors.

The power switch(es) 58 can have switch magnets. The switch magnets can controllably activate a hall-effect type magnetic switch on the board 80.

Figure 7:
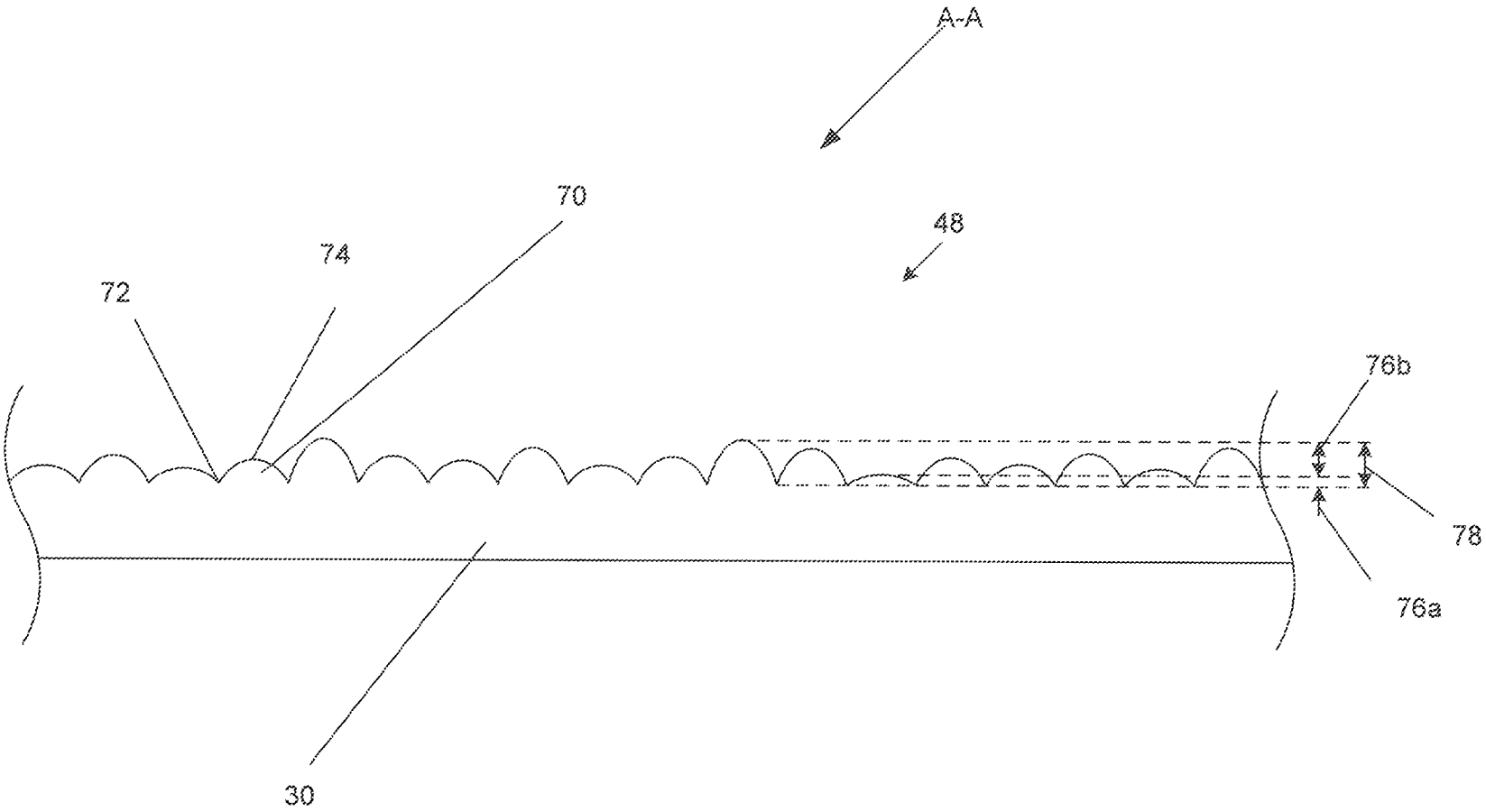
FIG. 7 illustrates a variation of a portion of section A-A of FIG. 5*a*.

FIG. 7 illustrates that the surface texturing 48 can have rounded projection 70, such as knurls, knobs, beads, or combinations thereof. The projections 70 can abut other, adjacent projections 70 on one, two, three or all sides. All of the projections 70 not against the edge of the surface texturing 48 can abut other, adjacent projections on all sides.

Projection nadirs 72 can be between abutting projections 70. Each projection 70 can each have a have a projection apex 74. Each projection 70 can have a variably selected thickness compared with the other projections 70. All of the projection nadirs 72 can be at about the side thickness through the wall 30. A projection thickness 76 for each projection 70 can be the thickness from the projection nadir 72 to the projection apex 74. The minimum projection thickness 76*a* can be from about 0 mm (0 in.) to about 0.5 mm (0.02 in.), for example about 0.25 mm (0.0098 in.). The maximum projection thickness 76*b* can be from about 0.5 mm (0.02 in.) to about 2 mm (0.08 in.), for example about 1 mm (0.04 in.). The difference between the maximum projection thickness 76*b* and the minimum projection thickness 76*b* can be a maximum projection differential 78. The maximum projection differential 78 can be from about 0 mm (0 in.) to about 1.5 mm (0.059 in.), for example about 0.75 mm (0.030 in.). The projection thicknesses 76 can be randomly distributed across the projections 70 between the minimum projection thickness 76*a* and maximum projection thickness 76*b*.

Figure 8:
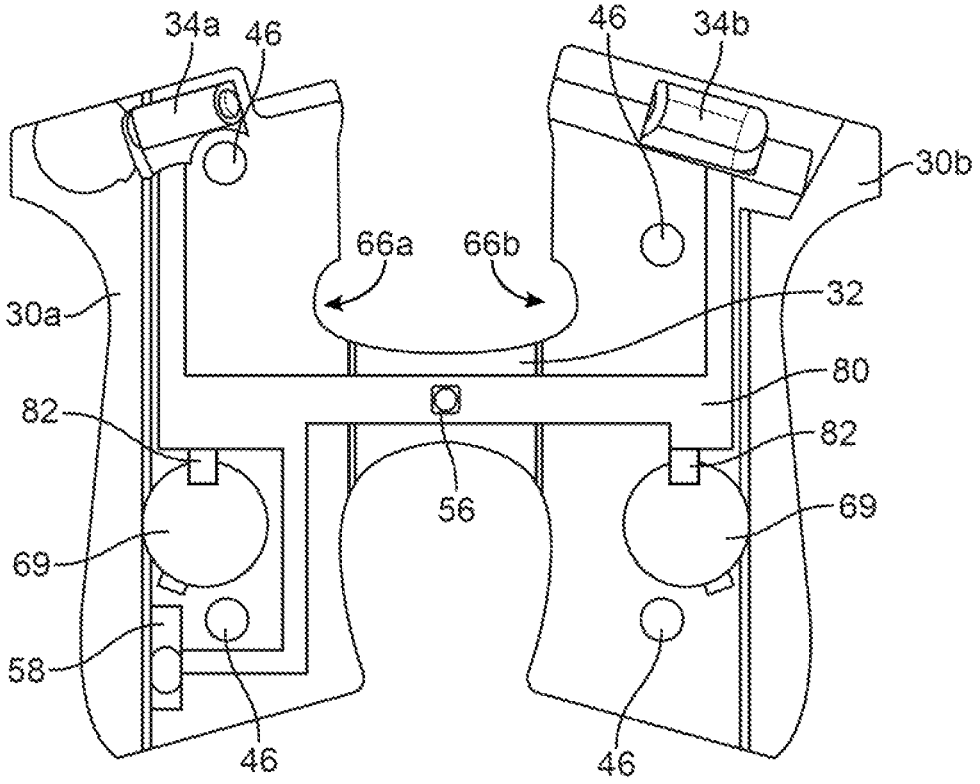
FIG. 8 is a rear view of the device in a flat configuration.

FIG. 8 illustrates that the grip cover 20 can be flexible. The grip cover 20 can be rigid. The grip cover 20 can be unwrapped from the grip 18. The grip cover 20 can be laterally expanded and contracted. For example, the walls 30 of the grip cover 18 can rotate away from each other at the strap 32 (acting as a hinge). The walls 30 can be rigid and/or flexible. The strap 32 can be rigid and/or flexible. For example, the walls 30 can both be rigid and the strap 32 can be flexible.

The grip cover 20 can have electronic control elements, such as a circuit board 80 and/or processor and the illumination activation control interface or element, such as the control switch 56. The circuit board 80 can be rigid, flexible or combinations thereof. For example, the circuit board 80 can be a rigid-flex board (also known as flex-rigid boards) made from a single board. The rigid-flex board can have one or more rigid fiberglass printed circuit board sections and one or more thin flexible sections. For example, the rigid sections can be in or on one or both of the walls 30 and the flexible section can be in or on the strap 32. The rigid sections and flexible sections can be in or on any combination of the walls 30 and the strap 32. A processor can be mounted on the circuit board 80.

The control elements can control or modulate the emission of light from the illumination device. The control switch 56 can be activated to toggle between illumination modes of the illumination device.

The control switch 56 and/or power switch(es) 58 can be pushbutton (e.g., can be pushed multiple time to toggle through the control abilities), lever, slide, rocker, roller wheel, single-throw switches, or combinations thereof. The circuit board 80 and control switch 56 can be configured to control or modulate the illumination element dependent on the control switch 56 activation. The control switch 56 can be activated (e.g., pressed, roller, rocked, slid) to turn the illumination elements: on until turned off by reactivating the control switch, to turn on while the control switch 56 is being continuously activated (e.g., holding down the pushbutton control switch 56), off, to strobe or flicker, to change color, to adjust the amplitude of the emitted light, to do any of the aforementioned control actions for only the illumination elements on the left side of the grip cover 20 and/or only illumination elements on the right side of the grip cover 20.

The control switch 56 can be operated by the trigger finger or another finger on the trigger finger's hand. The trigger finger hand can concurrently hold the grip 18 while operating the control switch 56. The trigger finger hand can concurrently discharge the gun 10 (e.g., pull the trigger) and operate the control switch 56. For example, the trigger finger can pull the trigger 16 while a non-trigger finger (e.g., the middle finger) presses the control switch 56.

The grip cover 20 can have electrical connection elements that can place combinations of the batteries 69, circuit board 80 and/or processor, control switch 56, power switch(es) 58, illumination elements, in electrical communication with each other. The electrical connection elements can be wires, cables, wireless connections (e.g., bluetooth, RF, near field communication, wireless energy transfer), direct soldering or connectors (e.g., to the circuit board), or combinations thereof. The electrical connection elements can be located partially or completely in the wiring channels 54, or not placed in any recessed configurations including the wiring channels 54.

The grip cover 20 can have electronic power elements, such as one or more batteries 69 (e.g., CR2032 coin batteries) and the master power switch 58. The master power switch 58 can close the circuit between the batteries 69 and the circuit board 80, connecting the batteries 69 to the circuit board 80. The circuit board 80 can then be in a state to receive and act on signals from the control switch 56. The master power switch 58 can be a slide, toggle switch, or combinations thereof. The function of the master power switch 58 can be performed by the control switch 56 (e.g., by holding the control switch depressed for more than 3 seconds). The batteries 69 can be held in the battery cavities 52 with battery tabs 82.

Figure 9:
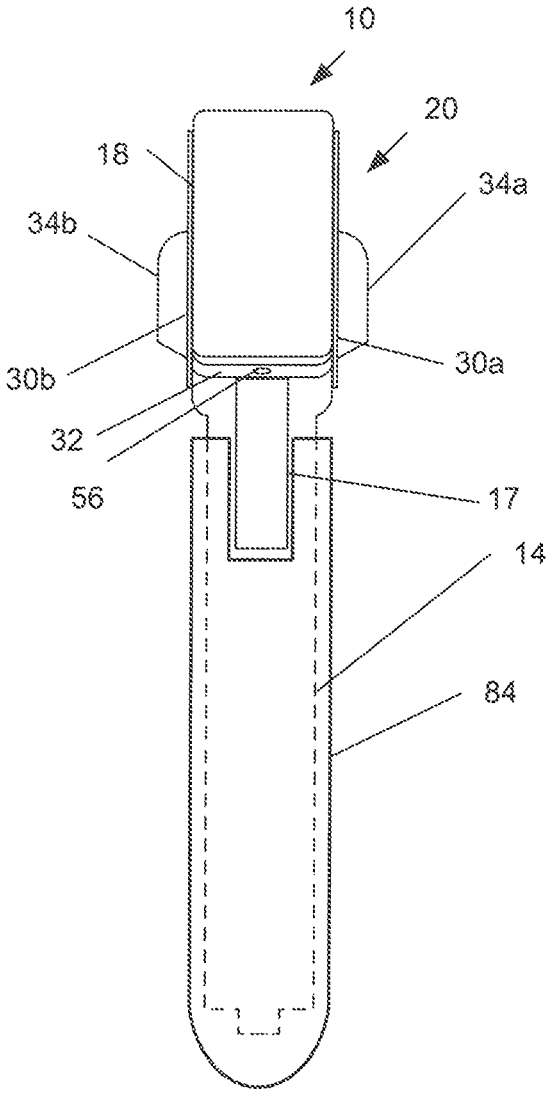
FIG. 9 illustrates a variation of the gun with the illumination device in a holster.

FIG. 9 illustrates that the gun 10 with the grip cover 20 can be placed into a holster 84. The holster 84 can receive and seat the barrel 14. When the barrel 14 is in a fully-holstered position, the illumination element holders 34 can be positioned outside of the holster 84. The illumination element holders 34 can be free from interfering with the holster 84 during holstering and unholstering of the gun 10.

The grip cover 20 and any or all elements disclosed herein can be made from metal, plastic, rubber, fiber composites, or combinations thereof, such as rigid reinforced (e.g., with fiberglass or carbon fiber) polycarbonate or nylon engineering plastics. The strap 32 can be overmolded on the walls 30. The strap 32 can be made from styrene butadiene (SBR), thermoplastic vulcanizate (TPV), thermoplastic elastomer (TPE), or thermoplastic polyurethane (TPU), or cast or compression molded from liquid urethanes and other resins or rubbers, or combinations thereof.

The grip cover 20 can weight from about 20 g (0.04 oz.) to about 70 g (2 oz.), more narrowly from about 20 g (0.04 oz.) to about 50 g (2 oz.), for example about 35 g (1.2 oz.). The center of mass (i.e., center of gravity) of the grip cover 20 can be on the grip 18. The center of mass of the gun 10 can be on the grip 18. The center of mass of the gun 10 without the grip cover 20 attached to the gun 10 can be in approximately the same location as the center of mass with the grip cover 20 attached to the gun 10. The grip cover 20 can attach to the grip 18 near or at the center of gravity of the gun 10, for example on or immediately in front of the grip 18. The moment arm about the grip 18 of the gun 10 without the grip cover 20 attached to the gun 10 can be approximately the same as the moment arm of the gun 10 with the grip cover 20 attached to the gun.

The illumination element can include a white light 5 mm barrel LED. The illumination element can be a gallium arsenide (GaAs) LED from Nichia Corporation of Tokushima, Japan (e.g., Nichia part number STS-DA1-1479A). For example, each illumination element can have a luminous intensity from about 5 cd to about 200 cd, more narrowly from about 10 cd to about 50 cd, yet more narrowly from about 20 cd to about 40 cd, for example about 33 cd The grip cover 20 can be integral with the grip 18. For example, the grip cover 20 can be molded as a portion of the grip 18. The battery, processor, wiring and LEDs of the grip cover 18 can be inserted into recessed portions of the grip cover 20 and covered with removable covers or panels.

The circuit board 80 as used herein can include a processor or be a processor. The circuit board 80 can be analog (e.g., having no processor).

Any elements described herein as singular can be pluralized (i.e., anything described as "one" can be more than one). Any species element of a genus element can have the characteristics or elements of any other species element of that genus. The above-described configurations, elements or complete assemblies and methods and their elements for carrying out the invention, and variations of aspects of the invention can be combined and modified with each other in any combination.

We claim:

1. A sighting apparatus for a handgun having a grip, the grip having a pair of generally opposed, generally flat sides and a front and rear, the sighting apparatus comprising:

a grip cover including left and right portions generally coextensive with the flat sides of the grip;

a first illumination element carried by one of the left and right portions of the grip cover, the first illumination element extending laterally beyond the side of the grip by a selected distance;

a second illumination element carried by another of the left and right side portions of the grip cover, the second illumination element extending laterally beyond the side of the grip by a selected distance; and an illumination activation control interface coupled to each of the illumination elements to selectively activate the illumination elements in response to user input.

2. The sighting apparatus of claim 1, wherein the first illumination element produces non-collimated light and the second illumination element produces collimated light.

3. The sighting apparatus of claim 1 further comprising:

a connecting strap connecting the left and right side portions of the grip cover.

4. The sighting apparatus of claim 3, wherein the illumination activation control interface is carried on the connecting strap.

5. The sighting apparatus of claim 1, wherein the first and second illumination elements are disposed at upper ends of the left and right side portions of the grip cover, respectively.

6. The sighting apparatus of claim 4, wherein the connecting strap extends around the front of the grip.

7. A sighting apparatus for a handgun having a grip and a trigger, the grip having a pair of generally opposed, generally flat sides and a front and rear, the sighting apparatus comprising:

a grip cover including left and right portions, each portion secured to one of the flat sides of the grip;

a connecting strap coupling together the left and right portions of the grip cover;

a first illumination element carried by one of the left and right portions of the grip cover, the first illumination element extending laterally beyond the side of the grip by a selected distance, the first illumination element;

a second illumination element carried by another of the left and right side portions of the grip cover, the second illumination element extending laterally beyond the side of the grip by a selected distance; and a switch carried by the connecting strap to activate the illumination elements.

8. The sighting apparatus of claim 7, wherein the first illumination element produces non-collimated light and the second illumination element produces collimated light.

9. The sighting apparatus of claim 7, wherein the first and second illumination elements are disposed at upper ends of the left and right side portions of the grip cover, respectively.

10. The sighting apparatus of claim 7, wherein the connecting strap extends around the front of the grip of the handgun and below the trigger.

11. A sighting apparatus for a handgun having a grip and a trigger, the grip having a pair of generally opposed, generally flat sides and a front and rear, the sighting apparatus comprising:

a grip cover including left and right portions, each portion generally coextensive with and secured to one of the flat sides of the grip;

a connecting strap coupling together the left and right portions of the grip cover, the connecting strap extending around the front of the grip below the trigger;

a first illumination element producing non-collimated light, the first illumination element carried at an upper end of one of the left and right portions of the grip cover, the first illumination element extending laterally beyond the side of the grip by a selected distance;

a second illumination element producing collimated light, the second illumination element carried at an upper end of another of the left and right side portions of the grip cover, the second illumination element extending laterally beyond the side of the grip by a selected distance; and a switch carried by the connecting strap and coupled to the first and second illumination elements to activate the illumination elements.

* * * * *